US007275560B2

(12) United States Patent
Rogge

(10) Patent No.: US 7,275,560 B2
(45) Date of Patent: Oct. 2, 2007

(54) PRESSURE RELIEF DOOR FOR AIR DUCT WORK

(75) Inventor: Timothy J. Rogge, Eau Claire, WI (US)

(73) Assignee: A.J. Manufacturing, Inc., Bloomer, WI (US)

( * ) Notice: Subject to any disclaimer, the term of this patent is extended or adjusted under 35 U.S.C. 154(b) by 384 days.

(21) Appl. No.: 10/953,972

(22) Filed: Sep. 29, 2004

(65) Prior Publication Data

US 2006/0065308 A1 Mar. 30, 2006

(51) Int. Cl.
*F16K 15/03* (2006.01)
*E04H 9/00* (2006.01)

(52) U.S. Cl. ..... 137/527; 137/526; 251/65; 494/194

(58) Field of Classification Search ..... 137/526, 137/527, 527.8; 454/194; 251/65
See application file for complete search history.

(56) References Cited

U.S. PATENT DOCUMENTS

| | | | | | |
|---|---|---|---|---|---|
| 2,452,612 | A | * | 11/1948 | Swenberg | 137/512 |
| 2,910,209 | A | | 10/1959 | Nelson | |
| 2,935,771 | A | | 5/1960 | Hatcher, Jr. | |
| 3,040,393 | A | | 6/1962 | Dailey | |
| 3,332,170 | A | | 7/1967 | Bangs | |
| 3,374,580 | A | | 3/1968 | Ruff | |
| 3,402,655 | A | * | 9/1968 | Stephenson et al. | 454/194 |
| 3,528,453 | A | * | 9/1970 | Dunkelis | 137/527.8 |
| 3,541,945 | A | * | 11/1970 | Wexler | 454/359 |
| 3,684,342 | A | | 8/1972 | Jansen | |
| 3,685,206 | A | | 8/1972 | Kessler | |
| 3,782,062 | A | | 1/1974 | Woods | |
| 3,782,411 | A | * | 1/1974 | Turner | 137/467 |
| 3,788,514 | A | * | 1/1974 | Giacoma et al. | 220/89.1 |
| 3,818,655 | A | | 6/1974 | Carter | |
| 3,921,546 | A | * | 11/1975 | Makuch | 110/173 B |
| 3,957,001 | A | * | 5/1976 | Round | 110/173 B |

(Continued)

FOREIGN PATENT DOCUMENTS

| | | |
|---|---|---|
| DE | 20315631 U1 | 2/2004 |
| EP | 1406038 A2 | 4/2004 |
| JP | 01102241 | 4/1989 |
| JP | 04110544 A | 4/1992 |

OTHER PUBLICATIONS

Web article, www.philasafetydevices.com/homepage/works.html, entitled "Instant Response Even at Low Pressures", (2 pgs.).

(Continued)

*Primary Examiner*—John Rivell
(74) *Attorney, Agent, or Firm*—Gerald E. Helget; Briggs and Morgan, P.A.

(57) ABSTRACT

A pressure relief door system for use in a duct for relieving positive or negative pressure within the duct includes a frame to be mounted in the duct; a gasket in the frame; a hinged door mounted on the frame and sealing against the gasket; and an adjustable pressure relief mechanism normally holding the hinged door against the gasket and permitting the hinged door to open in response to a positive or negative pressure change. The frame and door can be mounted such that the door opens either outwardly from the duct in response to excess positive pressure or inwardly into the duct in response to excess negative pressure. The adjustable pressure relief mechanism may be magnetic.

20 Claims, 6 Drawing Sheets

U.S. PATENT DOCUMENTS

| | | | | | |
|---|---|---|---|---|---|
| 4,140,151 | A | * | 2/1979 | Van Becelaere | 137/526 |
| 4,184,509 | A | * | 1/1980 | Kasper | 137/526 |
| 4,207,706 | A | | 6/1980 | Haines | |
| 4,341,041 | A | | 7/1982 | Bloomfield | |
| 4,356,856 | A | | 11/1982 | Bengtsson | |
| 4,465,499 | A | | 8/1984 | Wawro et al. | |
| D275,603 | S | | 9/1984 | Brown | |
| 4,502,249 | A | | 3/1985 | Banford | |
| 4,513,939 | A | | 4/1985 | Berger | |
| 4,538,380 | A | | 9/1985 | Colliander | |
| 4,574,973 | A | | 3/1986 | Lewis, Jr. et al. | |
| 4,598,503 | A | | 7/1986 | Berger et al. | |
| 4,720,261 | A | | 1/1988 | Fishwick et al. | |
| 4,731,016 | A | | 3/1988 | Dixon | |
| 5,007,202 | A | | 4/1991 | Guillon | |
| 5,069,401 | A | | 12/1991 | Shepherd et al. | |
| 5,107,622 | A | | 4/1992 | Fuchs et al. | |
| 5,161,573 | A | * | 11/1992 | Krupp | 137/526 |
| 5,172,519 | A | | 12/1992 | Cooper | |
| 5,177,868 | A | | 1/1993 | Kyle et al. | |
| 5,279,515 | A | | 1/1994 | Moore et al. | |
| 5,305,969 | A | | 4/1994 | Odell et al. | |
| 5,414,961 | A | | 5/1995 | Tessier | |
| 5,467,764 | A | | 11/1995 | Gamow | |
| 5,560,154 | A | | 10/1996 | Matarazzo | |
| 5,581,951 | A | | 12/1996 | Ryan et al. | |
| 5,711,706 | A | | 1/1998 | Griffin et al. | |
| 5,716,271 | A | * | 2/1998 | Paidosh | 454/359 |
| 5,791,408 | A | | 8/1998 | Seem | |
| 5,921,043 | A | | 7/1999 | McDonald | |
| 6,223,473 | B1 | | 5/2001 | Romig | |
| 6,488,048 | B2 | | 12/2002 | Kühmayer et al. | |

OTHER PUBLICATIONS

Web article, www.greenheck.com/products/dampers/, entitled "Dampers", (1 pg.).

Kees Incorporated brochure entitled "Positive Pressure Relief Door", (5 pgs.).

Web article, www.ruskin.com, entitled "Positive Pressure Relief Door", (1 pg.).

Web article, www.mcgillairflow.com, entitled "Access Doors for Duct Systems", (2 pgs.).

Dexter Magnetic Technologies, entitled Nd-Fe-B Material Properties, (2 pgs.).

Ruskin Manufacturing Engineering Report entitled (Controlled Closure Fire/Smoke Damper Design Eliminates HVAC Duct System Damage, (4 pgs.).

United McGrill Corporation Engineering Bulletin entitled "Collapse of Supply Duct", (2 pgs.).

Temtrol Brochure entitled "Custom Tailored Air Handling Products", (26 pgs.).

University of Washington Enginnering Services Facility Design Information Packet, Aug. 2002, (12 pgs.).

* cited by examiner

ALTERNATE MOUNTING CONFIGURATION

LOW PRESSURE SETTING (BRACKET CLOSER TO HINGES)

HIGH PRESSURE SETTING (BRACKET FURTHER FROM HINGES)

PRESSURE RELIEF DOOR FOR AIR DUCT WORK

BACKGROUND OF THE INVENTION

The present invention relates to a pressure relief door and particularly to a pressure relief door that can respond to both positive and negative pressures in a heating, ventilation, and air-conditioning (HVAC) system. Such systems include one or more fans for moving air and ductwork through which the air moves. Dampers are also provided in such systems to automatically close in response to fire or smoke.

The function of a pressure relief door is to prevent ductwork from imploding or exploding in the event dampers close while the fan is still operating. Opening outward or inward at a specified pressure setting, the present invention permits rapid neutralization of the pressure differential between the inside and outside of the HVAC system.

HVAC duct damage due to instantaneous closure of dampers is a potential problem and concern of design engineers and contractors. Laboratory tests prove that extreme pressures occur upstream and downstream of instantaneously closing dampers. FIG. 4 shows a possible scenario. Assume there is a run of duct similar to that shown. If a damper L closes for some unexpected reason with the system in operation, the damper L effectively stops the passage of air through the damper.

A moving column of air has mass and therefore has inertia. Thus, the air immediately downstream of the damper will continue to move after the damper closes. Since no air can pass through the closed damper to replace this moving column of air, a void, or partial vacuum, is left in the duct. The kinetic energy of this moving column of air is a function of air velocity. At low air velocities, there would not be enough kinetic energy developed to be a problem, but as velocity increases, a tremendous amount of energy will be developed which can create a problem in large duct diameters.

Two ways have been used to protect ducts from collapse in this situation. Some manufacturers of dampers have developed devices that prevent the instantaneous closing of dampers, giving the duct a chance to adapt to the changed condition. However, delaying the closing of a damper can cause severe results in the case of a fire, for example. The other method of protection is to install a pressure relief door in the ductwork downstream from the damper, so that the pressure relief door will open to relieve the partial vacuum when the partial vacuum reaches a previously set point. However, such previous devices have not been easily pre-set at the factory.

Explosion relief panels and doors have been used previously to relieve excess pressure within a system due to an explosion, but such panels have generally not also been usable as negative pressure relief doors.

There is a need for a pressure relief door that can be installed in a duct to open inwardly or outwardly in response, respectively, to excess negative or positive pressure in the duct. The door must be easily pre-set at the factory to open in response to a particular pressure.

SUMMARY OF THE INVENTION

A pressure relief door system for use in a duct for relieving positive or negative pressure within the duct, the door system comprising:

(a) a frame adapted to be mounted in the duct;

(b) a gasket in the frame;

(c) a hinged door mounted on the frame and sealingly engaging the gasket; and (d) an adjustable pressure relief mechanism normally holding the hinged door against the gasket and permitting the hinged door to open in response to a pressure change;

(e) wherein the pressure change can be positive or negative.

A principal object and advantage of the present invention is that the same door system can be installed to protect against either positive or negative over-pressure, thus protecting the duct against an explosion or implosion due to a damper closing.

Another principal object and advantage of the present invention is that the same door system can be installed so that the door opens either outwardly from the duct or inwardly into the duct.

Another principal object and advantage of the present invention is that it includes an adjustable pressure relief mechanism that is easily pre-set at the factory.

DETAILED DESCRIPTION OF THE PREFERRED EMBODIMENT

Figure 1:
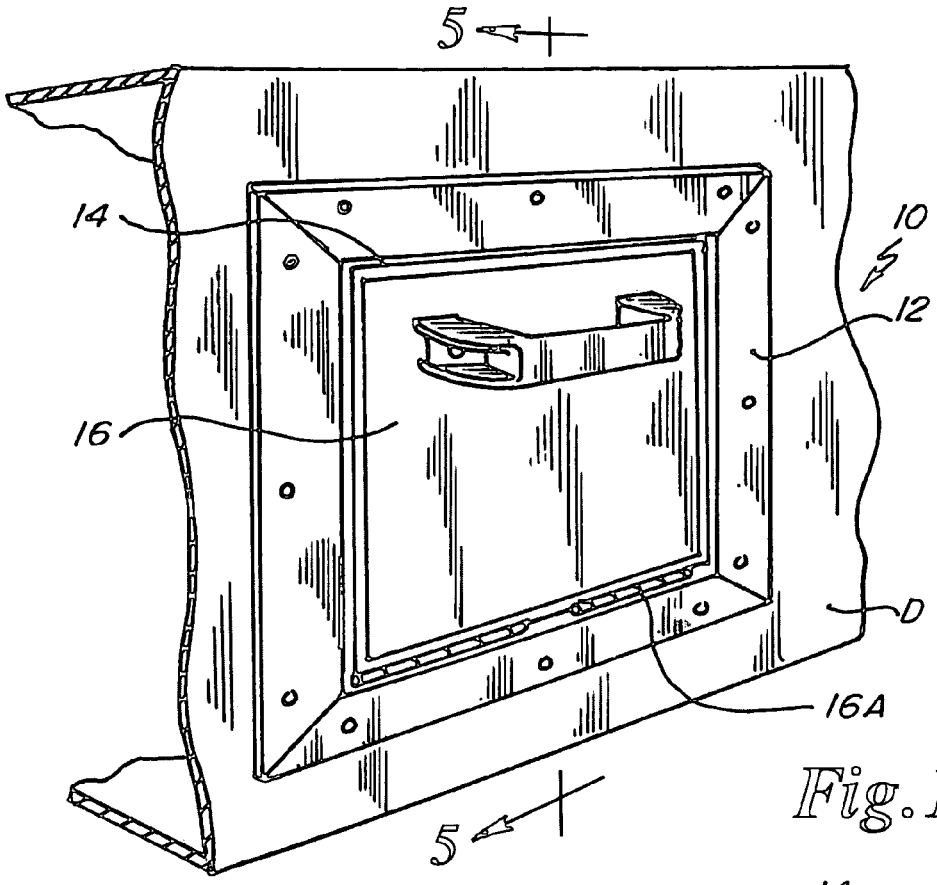
FIG. 1 is a front perspective view of the present invention mounted on the outside of a duct.

The present invention is generally denoted in the drawings as reference numeral 10.

Turning first to FIG. 1, the pressure relief door system 10 for use in a duct D for relieving positive or negative pressure within the duct D further comprises a frame 12 adapted to be mounted in the duct D; a gasket 14 in the frame 12; a hinged door 16 mounted on the frame 12 by a hinge 16A and sealingly engaging the gasket 14; an adjustable pressure relief mechanism 18 (FIG. 2) normally holding the door 16 against the gasket 14 and permitting the hinged door 16 to open in response to a pressure change; wherein the pressure change can be positive or negative.

FIG. 1 shows that the pressure relief door system 10 can be mounted in the duct D so that the hinged door 16 can swing outwardly from the duct D, thereby relieving a positive pressure change within the duct D.

Figure 3:
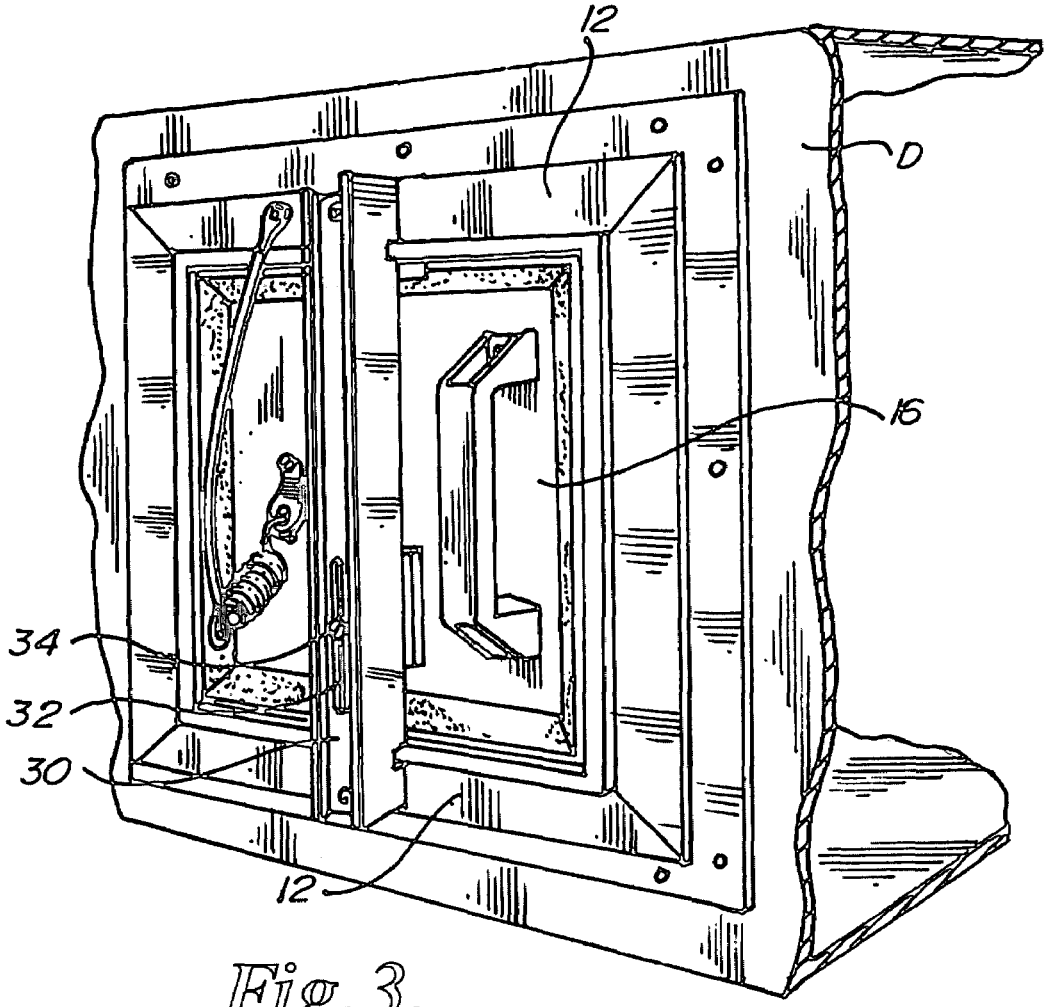
FIG. 3 is a front perspective view of the present invention mounted on the inside of a duct.

Turning to FIG. 3, it will be seen that the pressure relief door system 10 can be mounted in the duct D so that the hinged door 16 can swing inwardly into the duct D, thereby relieving a negative pressure change in the duct D.

Figure 2:
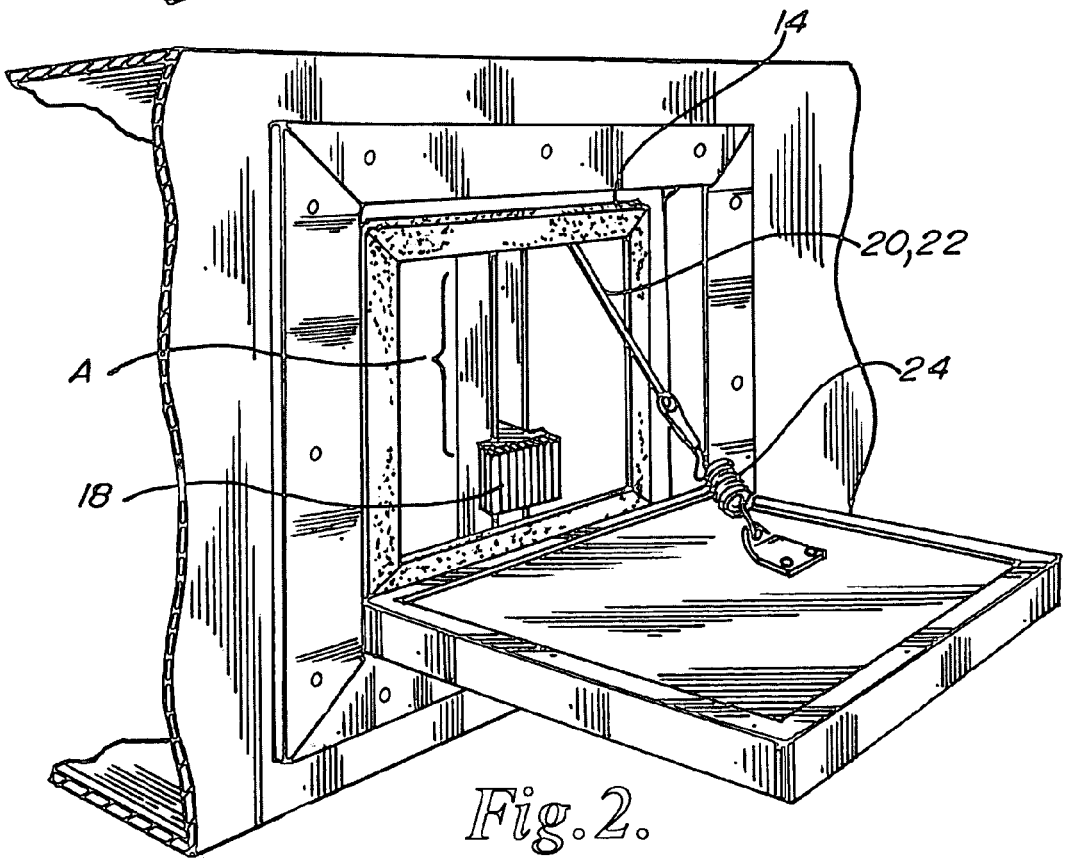
FIG. 2 is similar to FIG. 1, showing the door of the present invention in its open position.

Turning to FIG. 2, it will be seen that the pressure relief door system 10 may also preferably comprise a limiter 20 to prevent the door 16 opening beyond a certain point, thereby preventing damage to the duct D. The limiter 20 preferably comprises a cable 22 and a spring 24 attached to the door 16 and the frame 12.

Preferably, the pressure relief system 18 can be pre-set to a setting in the range of about 1 inch water gauge to about 12 inches water gauge.

In the preferred embodiment, the pressure relief system 18 is magnetic.

Figure 5:
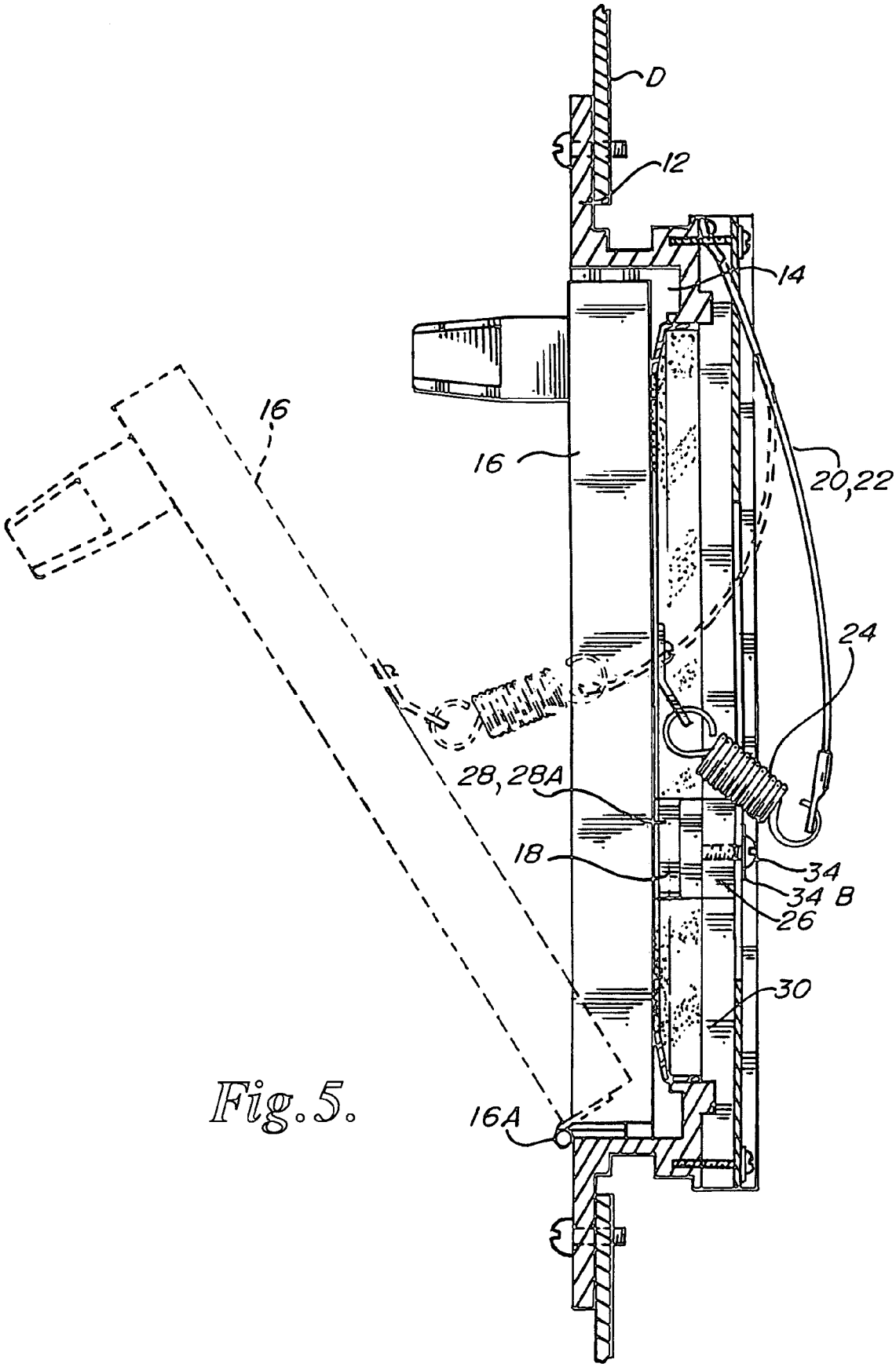
FIG. 5 is a partial cross-section approximately along the lines 5 in FIG. 1.
Figure 6:
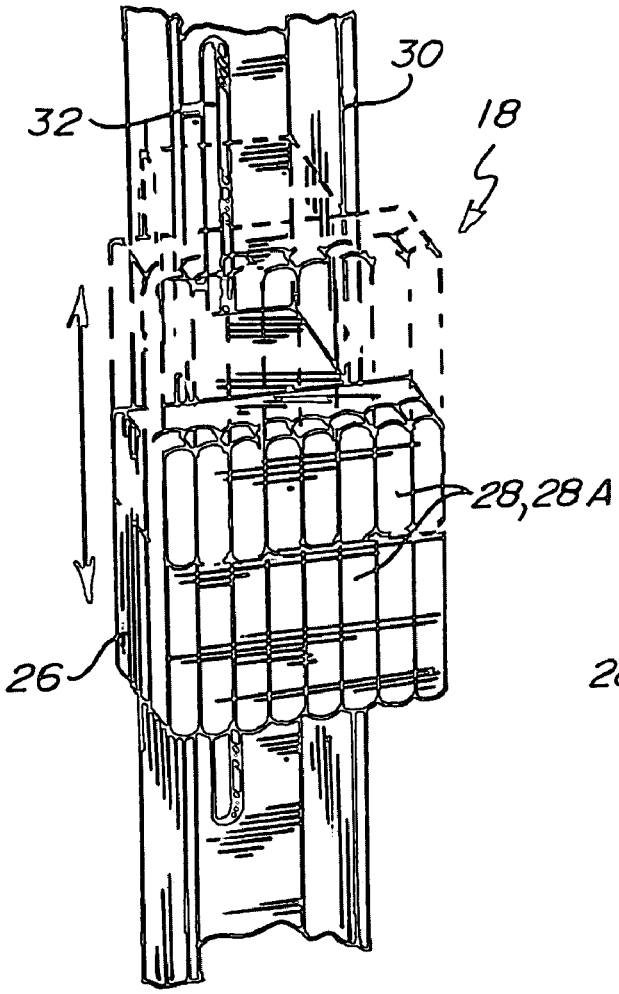
FIGS. 6 and 7 are detailed views of one embodiment of an adjustable pressure relief mechanism of the present invention.
Figure 7:
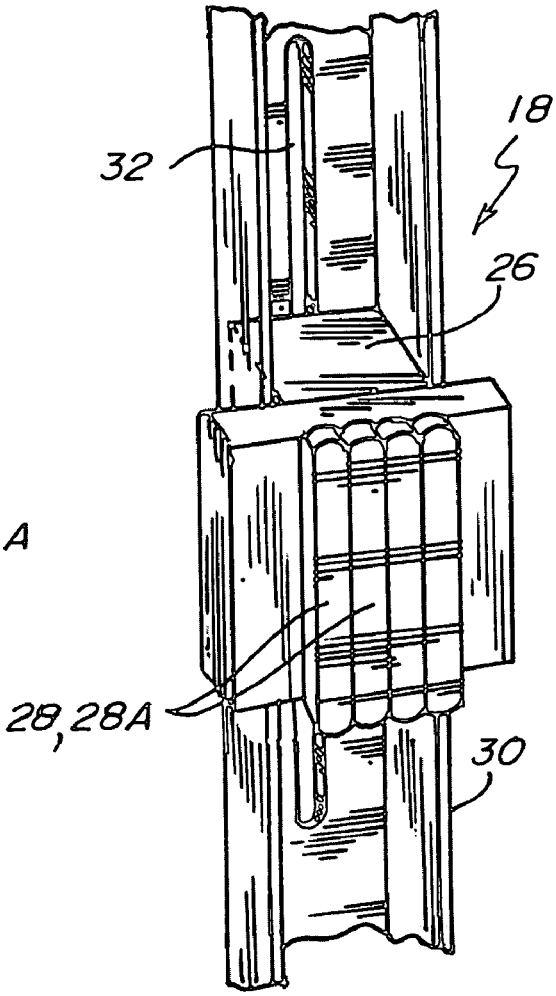

Turning to FIGS. 5, 6 and 7, in the most preferred embodiment, the pressure relief system 18 further comprises a magnet 28 mounted to the frame 12, the magnet attracting the door 16, and wherein the magnet 28 can be moved toward and away from the door hinge 16A, thereby providing decreased and increased opening pressure settings, respectively. Preferably, the magnet 28 is magnetically mounted to a block 26 which in turn is mounted to the frame.

Turning to FIGS. 3 and 5, preferably, the pressure relief system 18 further comprises a bar 30 mounted on the frame 12, the bar 30 having a slot 32, and a releasable fastener 34 securing the magnet 28 at various positions along the slot 32 relative to the door hinge 16A. Preferably, the releasable fastener further comprises a screw 34A and a lock washer 34B secured to the block 26.

Turning to FIGS. 6 and 7, the operation of the preferred embodiment of the pressure relief system 18 will now be explained.

To fine-tune the pressure relief system 18 to the exact specifications requested by a customer, the releasable fastener 34 is loosened and the block 26 and magnet 28 are moved along the slot 32 as shown by the arrows, to the position shown in phantom. If the magnet 28 is moved toward the hinge 16A, releasing pressure is decreased because there is a greater arm A (between the magnet 28 and the edge of the door opposite the hinge 16A) upon which pressure may act, as shown in FIG. 2. Conversely, if the magnet 28 is moved away from the hinge 16A (not shown), releasing pressure is increased because there is a smaller arm between the magnet 28 and the edge of the door opposite the hinge 16A upon which pressure may act. The length of the arm A thus governs the force acting to separate the magnet 28 from the door 16, thus releasing the door 16.

Table 1 shows the approximate relationship between adjustment distance of the magnet from the hinge and air pressure (W.G. or water gauge) It will be recognized that this table is only exemplary and depends on the tensile force of the magnet.

TABLE 1

| Door Size (inches) | Latch adjustment per 1" W.G. |
|---|---|
| 10 × 10 | ⅜" |
| 12 × 12 | ¾" |
| 18 × 18 | 1" |
| 24 × 24 | 2½" |

In the preferred embodiment, the door 16 (at least on side facing the bar 30) is constructed of a magnetically attracting material such as steel, so that the magnet 28 may be attracted to it.

FIGS. 6 and 7 show that releasing pressure can be further fine-tuned if the magnet 28 further comprises a plurality of magnets 28A, and some of the plurality of magnets 28A are removed, as shown in FIG. 7.

Figure 8B:
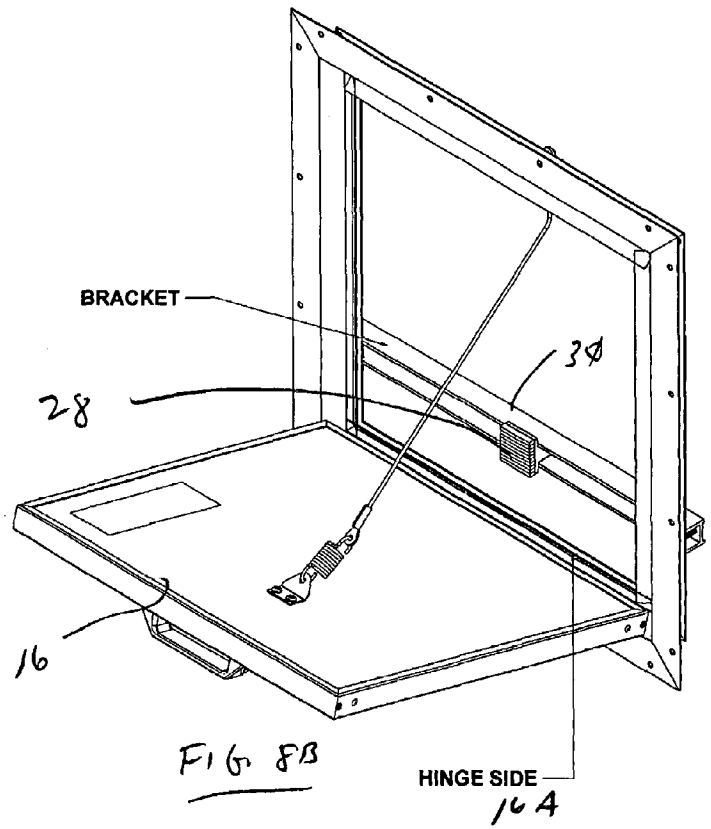
FIG. 8 shows that the adjustable pressure relief mechanism may be mounted horizontally on the door.
Figure 8A:
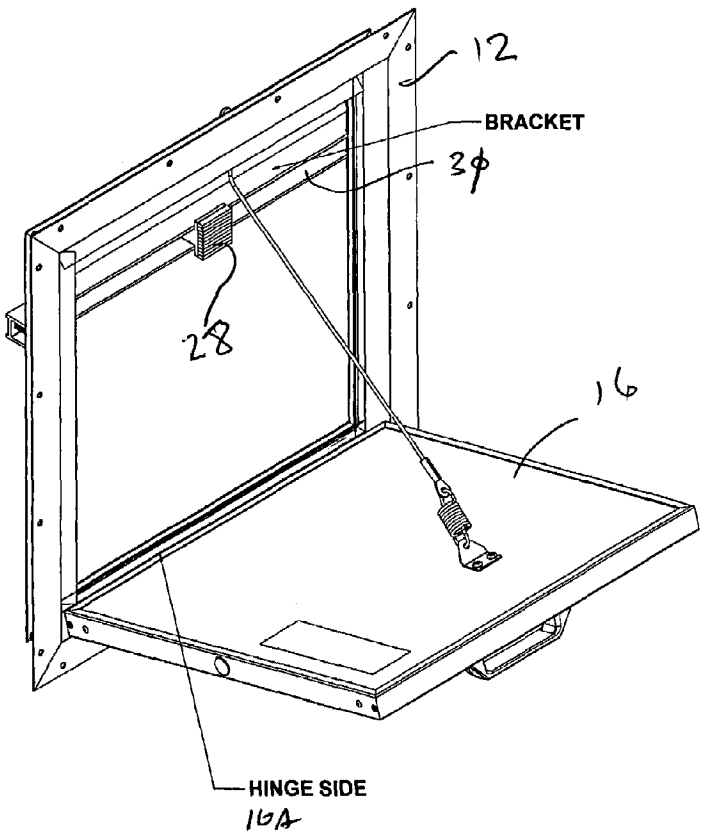

FIGS. 8A and 8B show that the bar 30 may also be horizontally mounted. The position of the bar 30 relative to the hinge 16A may be varied to set releasing pressure as earlier described, but moving the bar 30 rather than the magnet 28.

Figure 9B:
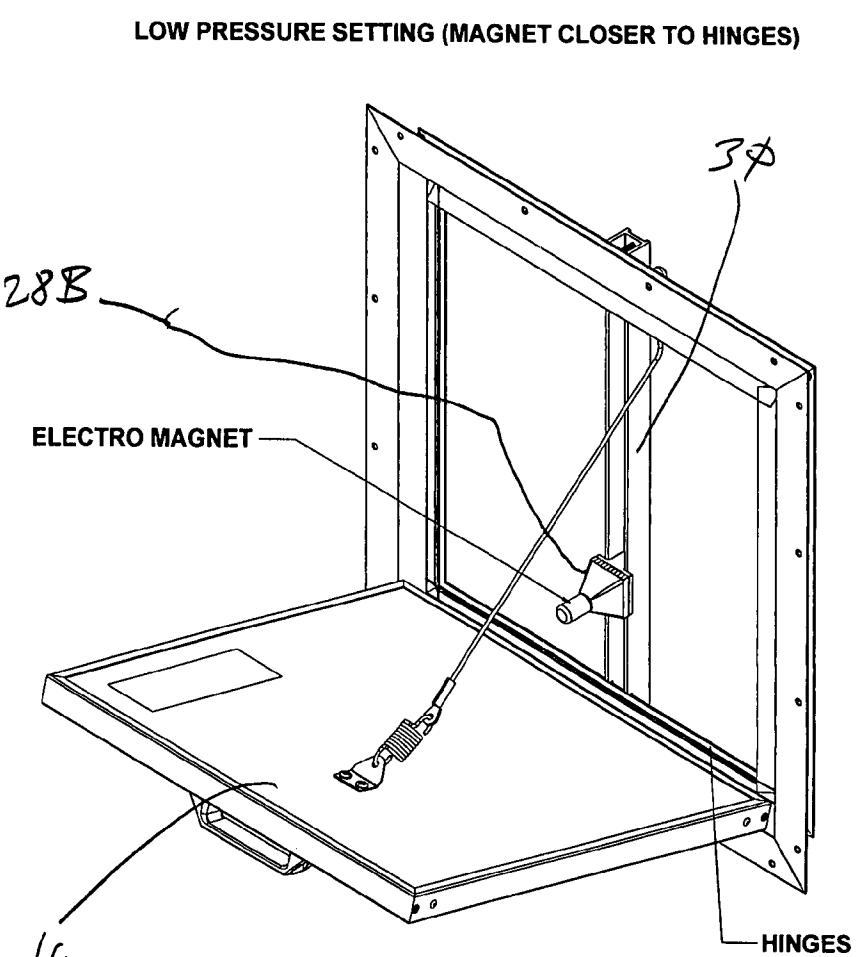
FIGS. 9A and 9B show that the adjustable pressure relief mechanism may be an electromagnet.
Figure 9A:
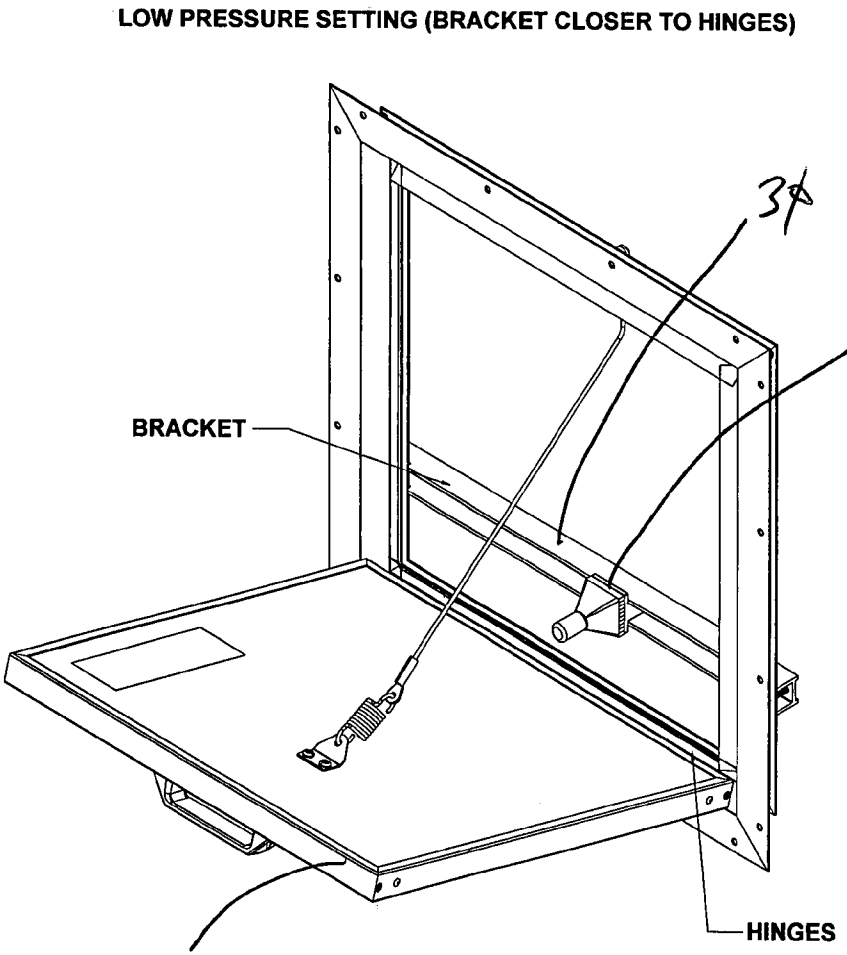

FIGS. 9A-9B show that the magnet 28 may also be an electromagnet 28B, either horizontally (FIG. 9A) or vertically (FIG. 9B) mounted.

Figure 4:
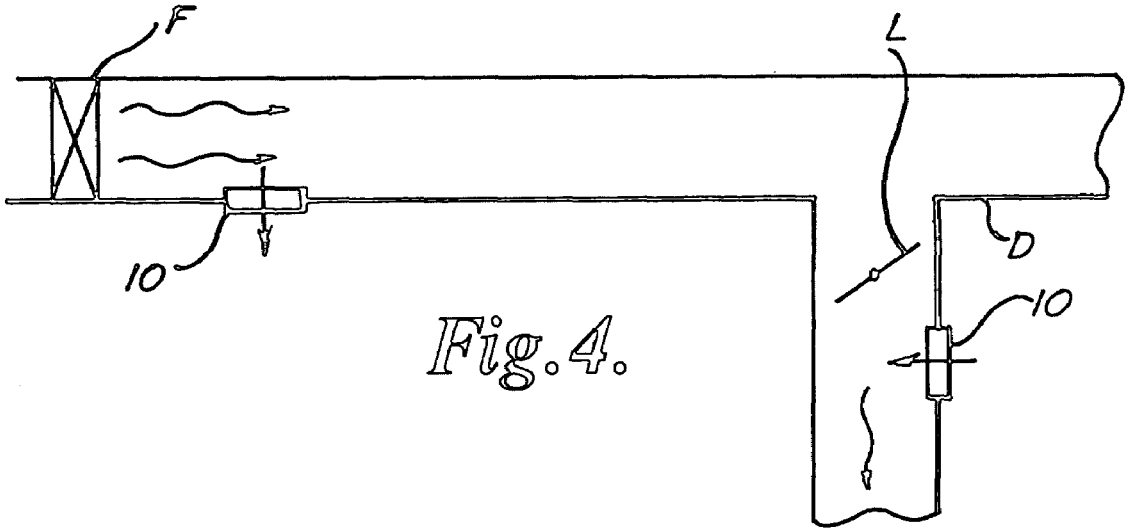
FIG. 4 is a schematic showing the use of the present invention in a duct.

FIG. 4 shows that the pressure relief door system 10 can be inserted in the duct D upstream from the damper L as in the left of the Figure, or downstream from the damper L as shown in the right of the Figure. If inserted upstream from the damper L, the system 10 is mounted to the duct D so that the door 16 opens outwardly to relieve positive pressure. If mounted downstream from the damper L, the system 10 is mounted in the duct D so that the door 16 opens inwardly to relieve negative pressure.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A pressure relief door system for use in a duct for relieving either positive or negative pressure within the duct, the door system comprising:

(a) a frame adapted to be mounted in the duct;

(b) a gasket in the frame;

(c) a hinged door mounted on the frame by a hinge and sealingly engaging the gasket; and (d) an adjustable pressure relief mechanism normally holding the hinged door against the gasket and permitting the hinged door to open in response to a pressure change;

(e) wherein the pressure change can be either positive or negative;

(f) wherein the pressure relief mechanism is magnetic; and (g) wherein the pressure relief mechanism further comprises a magnet mounted to the frame, the magnet attracting the door, and wherein the magnet can be moved toward and away from the door hinge, thereby providing decreased and increased opening pressure settings, respectively.

2. The door system of claim 1, wherein the frame and hinged door can be mounted in the duct so that the hinged door can either swing inwardly or swing outwardly.

3. The door system of claim 1, further comprising a limiter to prevent the door opening beyond a certain point, thereby preventing damage to the duct.

4. The door system of claim 3, wherein the limiter further comprises a cable and spring attached to the door and frame.

5. The door system of claim 1, wherein the pressure relief mechanism can be pre-set to a setting in the range of about 1 inch water gauge to about 12 inches water gauge.

6. The door system of claim 1, further comprising a bar mounted on the frame, the bar having a slot, and a releasable fastener securing the magnet at various positions in the slot relative to the door hinge.

7. The door system of claim 6, wherein the releasable fastener further comprises a screw and lock washer.

8. A pressure relief door system for use in a duct for relieving either positive or negative pressure within the duct, the door system comprising:

(a) a frame adapted to be mounted in the duct;

(b) a gasket in the frame;

(c) a hinged door mounted on the frame and sealingly engaging the gasket; and (d) an adjustable pressure relief mechanism normally holding the hinged door against the gasket and permitting the hinged door to open in response to a pressure change;

(e) wherein the adjustable pressure relief mechanism further comprises a door-gripping apparatus movable toward and away from the hinge, thereby changing the arm between the door-gripping apparatus and the door edge opposite the hinge upon which pressure may act: and (f) wherein the frame and hinged door can be mounted in the duct so that the hinged door can either swing inwardly or swing outwardly.

9. The door system of claim 8, further comprising a limiter to prevent the door opening beyond a certain point, thereby preventing damage to the duct.

10. The door system of claim 9, wherein the limiter further comprises a cable and spring attached to the door and frame.

11. The door system of claim 8, wherein the pressure relief mechanism can be pre-set to a setting in the range of about 1 inch water gauge to about 12 inches water gauge.

12. The door system of claim 8, wherein the pressure relief mechanism is magnetic.

13. The door system of claim 12, wherein the door-gripping apparatus further comprises a magnet mounted to the frame, the magnet attracting the door, and wherein the magnet can be moved toward and away from the door hinge, thereby providing decreased and increased opening pressure settings, respectively.

14. The door system of claim 13, further comprising a bar mounted on the frame, the bar having a slot, and a releasable fastener securing the magnet at various positions in the slot relative to the door hinge.

15. The door system of claim 14, wherein the releasable fastener further comprises a screw and lock washer.

16. A pressure relief door system for use in a duct for relieving positive or negative pressure within the duct, the door system comprising:

(a) a frame adapted to be mounted in the duct;

(b) a gasket in the frame;

(c) a hinged door mounted on the frame and sealingly engaging the gasket; and (d) an adjustable pressure relief mechanism normally holding the hinged door against the gasket and permitting the hinged door to open in response to a pressure change;

(e) wherein the pressure change can be positive or negative;

(f) wherein the frame and hinged door can be mounted in the duct so that the hinged door can swing inwardly or outwardly; and (g) wherein the pressure relief mechanism further comprises a magnet mounted to the frame, the magnet attracting the door, and wherein the magnet can be moved toward and away from the door hinge, thereby providing decreased and increased opening pressure settings, respectively.

17. The door system of claim 16, further comprising a bar mounted on the frame, the bar having a slot, and a releasable fastener securing the magnet at various positions in the slot relative to the door hinge.

18. The door system of claim 17, wherein the releasable fastener further comprises a screw and lock washer.

19. The door system of claim 16, wherein the magnet further comprises a plurality of magnets, each of the plurality of magnets being individually attachable to the frame, thereby allowing fine-tuning of the pressure relief mechanism.

20. A pressure relief door system for use in a duct for relieving either positive or negative pressure within the duct, the door system comprising:

(a) a frame adapted to be mounted in the duct;

(b) a gasket in the frame;

(c) a hinged door mounted on the frame by a hinge and sealingly engaging the gasket; and (d) an adjustable pressure relief mechanism normally holding the hinged door against the gasket and permitting the hinged door to open in response to a pressure change;

(e) wherein the adjustable pressure relief mechanism further comprises a door-gripping apparatus movable toward and away from the hinge, thereby changing the arm between the door-gripping apparatus and the door edge opposite the hinge upon which pressure may act;

(f) wherein the pressure change can be either positive or negative.

* * * * *